US006755450B1

(12) United States Patent
Chen

(10) Patent No.: US 6,755,450 B1
(45) Date of Patent: Jun. 29, 2004

(54) SAFETY DOOR LOCK

(76) Inventor: Hong Yao Chen, PO Box 82-144, Taipei (TW)

( * ) Notice: Subject to any disclaimer, the term of this patent is extended or adjusted under 35 U.S.C. 154(b) by 0 days.

(21) Appl. No.: 10/341,374

(22) Filed: Jan. 14, 2003

(51) Int. Cl.[7] ..... E05C 19/18

(52) U.S. Cl. ..... 292/295; 292/289; 292/292; 70/14; 70/102

(58) Field of Search ..... 292/295, 289, 292/292, 288, 266, 265, DIG. 37, DIG. 60; 70/14, 102, 101

(56) References Cited

U.S. PATENT DOCUMENTS

| | | | | | |
|---|---|---|---|---|---|
| 614,052 | A | * | 11/1898 | Jackson | 292/295 |
| 801,369 | A | * | 10/1905 | Dickson et al. | 292/295 |
| 826,538 | A | * | 7/1906 | Carter | 292/292 |
| 1,864,883 | A | * | 6/1932 | Anderson | 70/14 |
| 2,172,208 | A | * | 9/1939 | Kurtzon | 70/14 |
| 2,588,077 | A | * | 3/1952 | Beadle | 292/295 |
| 3,273,935 | A | * | 9/1966 | Carson | 296/76 |
| 3,563,593 | A | * | 2/1971 | Leier et al. | 292/296 |
| 3,664,164 | A | * | 5/1972 | Zaidener | 70/202 |
| 3,931,723 | A | * | 1/1976 | Kurtz | 70/14 |
| 4,003,227 | A | * | 1/1977 | Casey | 70/14 |
| 4,178,026 | A | * | 12/1979 | Sinkhorn | 292/295 |
| 4,356,580 | A | * | 11/1982 | Kurtz | 70/14 |
| 4,399,672 | A | * | 8/1983 | Moorhouse | 70/101 |
| 4,833,737 | A | * | 5/1989 | Boucher et al. | 4/253 |
| 4,878,701 | A | * | 11/1989 | Rondel et al. | 292/288 |
| 4,964,662 | A | * | 10/1990 | O'Leary et al. | 292/295 |
| 4,991,888 | A | * | 2/1991 | Cinnamond | 292/296 |
| 5,325,685 | A | * | 7/1994 | Frank | 70/14 |
| 5,401,068 | A | * | 3/1995 | Barnard | 292/289 |
| 5,419,165 | A | * | 5/1995 | Perkins | 70/14 |
| 5,462,323 | A | * | 10/1995 | Benninger | 292/292 |
| 5,819,561 | A | * | 10/1998 | Blehi, III | 70/14 |
| 5,836,626 | A | * | 11/1998 | Coy | 292/292 |
| 5,984,387 | A | * | 11/1999 | Zeller | 292/296 |
| 6,345,849 | B1 | * | 2/2002 | Yen | 292/343 |
| 6,546,766 | B1 | * | 4/2003 | Klingler | 70/230 |

FOREIGN PATENT DOCUMENTS

| | | | |
|---|---|---|---|
| GB | WO 90/01605 | * | 2/1990 |
| GB | 2276196 A | * | 9/1994 |

* cited by examiner

*Primary Examiner*—Robert J. Sandy
*Assistant Examiner*—Carlos Lugo
(74) *Attorney, Agent, or Firm*—Leong C. Lei

(57) ABSTRACT

A safety door lock is constructed to include a positioning plate for plugging into a mounting hole in the doorjamb, the positioning plate having a longitudinal sliding way and a serrated longitudinal rail along one side of the sliding way, and a stop plate assembly detachably inserted into the sliding way of the positioning plate for stopping the door panel in the closed status, the stop plate assembly including an angled bottom plate for stopping the door panel in the closed status, a movable engagement plate forced by a spring member into engagement with the serrated longitudinal rail of the positioning plate to stop the bottom plate from backward movement, and a spring-supported button for pressing by the user to disengage the movable engagement plate from the serrated longitudinal rail for enabling the stop plate assembly to be removed from the positioning plate.

6 Claims, 5 Drawing Sheets

SAFETY DOOR LOCK

BACKGROUND OF THE INVENTION

1. Field of the Invention

The present invention relates to door locks and, more particularly, to a safety door lock that can be unlocked by a person inside the house with the fingers and that is not openable by any person outside the house.

2. Description of the Related Art

Various door locking devices have been disclosed for use to lock the door, and have appeared on the market. In order to let the door be slightly opened without allowing people outside the house to pass to the inside of the house, a door bolt may be used. A conventional door bolt is known comprised of doorplate and a jamb plate. The doorplate is fixedly fastened to the free end of the door panel, having an elongated sliding slot. The jamb plate is fixedly fastened to the doorjamb, having a chain and a slide bolt at the end of the chain for coupling to the sliding slot of the doorplate. There is known another design of door bolt in which the jamb plate has a hinged retainer bar; the doorplate has a hook. When the door closed, the hinged retainer bar is turned toward the hook of the doorplate, enabling the longitudinal sliding slot of the hinged retainer bar to be coupled to the hook of the doorplate.

The aforesaid prior art door bolts are still not satisfactory in function. If the door is slightly opened without allowing people outside the house to pass to the inside of the house, a person outside the door can use a cutting device to cut off the chain or the hook. Further, the aforesaid prior art door bolts are not detachable when installed. A person cannot install a conventional door bolt in the door of the room when put up at a hotel.

SUMMARY OF THE INVENTION

The present invention has been accomplished under the circumstances in view. It is the main object of the present invention to provide a safety door lock, which is not openable by a person outside the house when locked. It is another object of the present invention to provide a safety door lock, which can easily be opened by a person inside the house.

To achieve these and other objects of the present invention, the safety door lock is comprised of a positioning plate for fastening to a doorjamb, and a stop plate assembly for fastening to the positioning plate to stop a door panel in a closed status closing on the doorjamb in which the positioning plate is installed. The stop plate assembly comprises a plurality of back mounting lugs disposed near one end thereof for plugging in a mounting hole in a doorjamb to secure the positioning plate to the doorjamb, a longitudinal sliding way defined in a front side thereof, and serrated means longitudinally extended along one side of the longitudinal sliding way. The stop plate assembly comprises a bottom plate insertable into the longitudinal sliding way of the positioning plate, the bottom plate comprising a vertical rear extension portion extended from a rear end thereof at right angles for stopping the door panel in the closed position, a shell covered on the bottom plate, the shell having a bottom pivot pin and a through hole, a movable engagement plate mounted inside the shell, the movable engagement plate comprising a pivot hole disposed in a rear end thereof and coupled to the bottom pivot pin of the shell, a cam hole disposed in a front end thereof, and a tooth protruded from one side thereof and adapted to engage the serrated means of the positioning plate and to further stop the stop plate assembly in the positioning plate, a first spring member connected between the movable engagement plate and a part inside the shell and adapted to force the tooth of the movable engagement plate into engagement with the serrated means of the positioning plate, a button mounted inside the shell and partially extended out of the through hole of the shell for pressing by the user, the button having a bottom rod inserted into the cam hole of the movable engagement plate and adapted to bias the movable engagement plate and to further disengage the tooth of the movable engagement plate from the serrated means of the positioning plate when the button pressed by the user, and a second spring member connected between one side wall of the button and a-part inside the shell.

DETAILED DESCRIPTION OF THE PREFERRED EMBODIMENT

Figure 1:
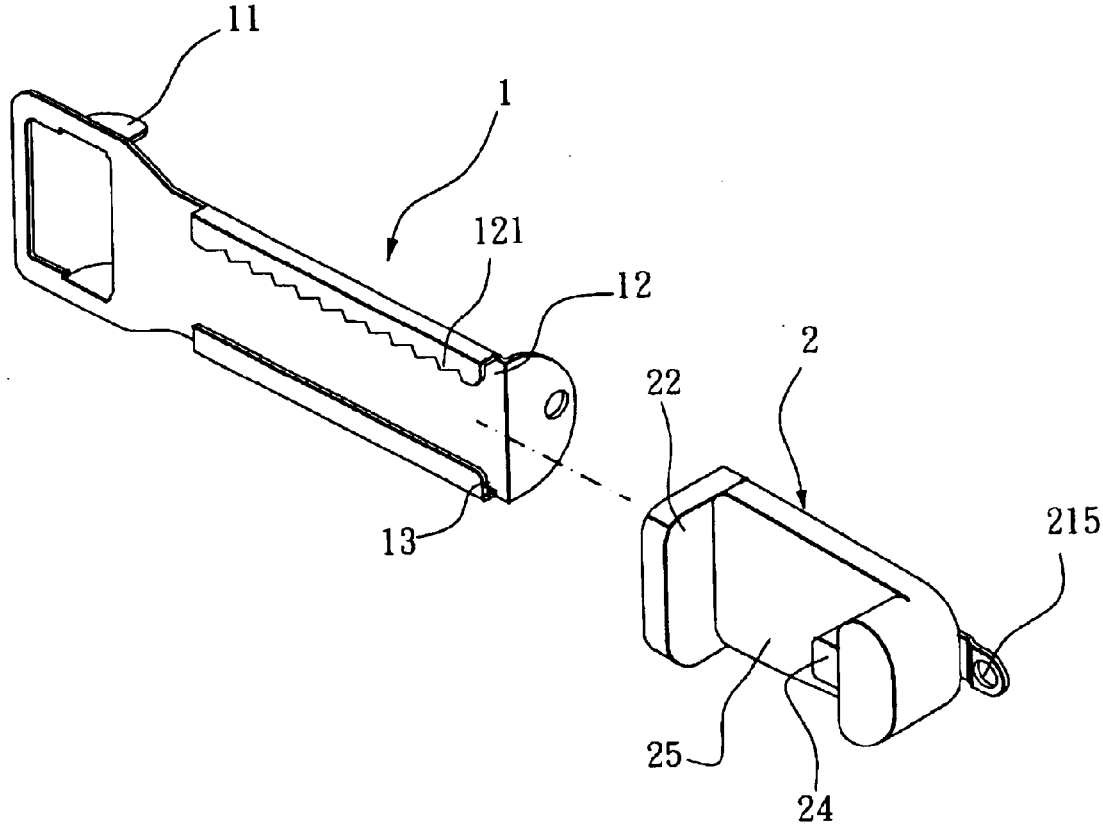
FIG. 1 is an exploded view of a safety door lock according to the present invention.

Referring to FIG. 1, a safety door lock in accordance with the present invention is shown comprised of a positioning plate 1 and a stop plate assembly 2. The positioning plate 1 is a rigid plate member having two mounting lugs 11 perpendicularly extended from the back side near one end and arranged substantially in parallel, two longitudinal rails 121 and 13 protruded from the front side and defined therebetween a longitudinal sliding way 12. One longitudinal rail 121 is longitudinally serrated. The maximum distance between the mounting lugs 11 is approximately equal to the vertical height of the mounting hole 31 in the doorjamb 3.

Figure 2:
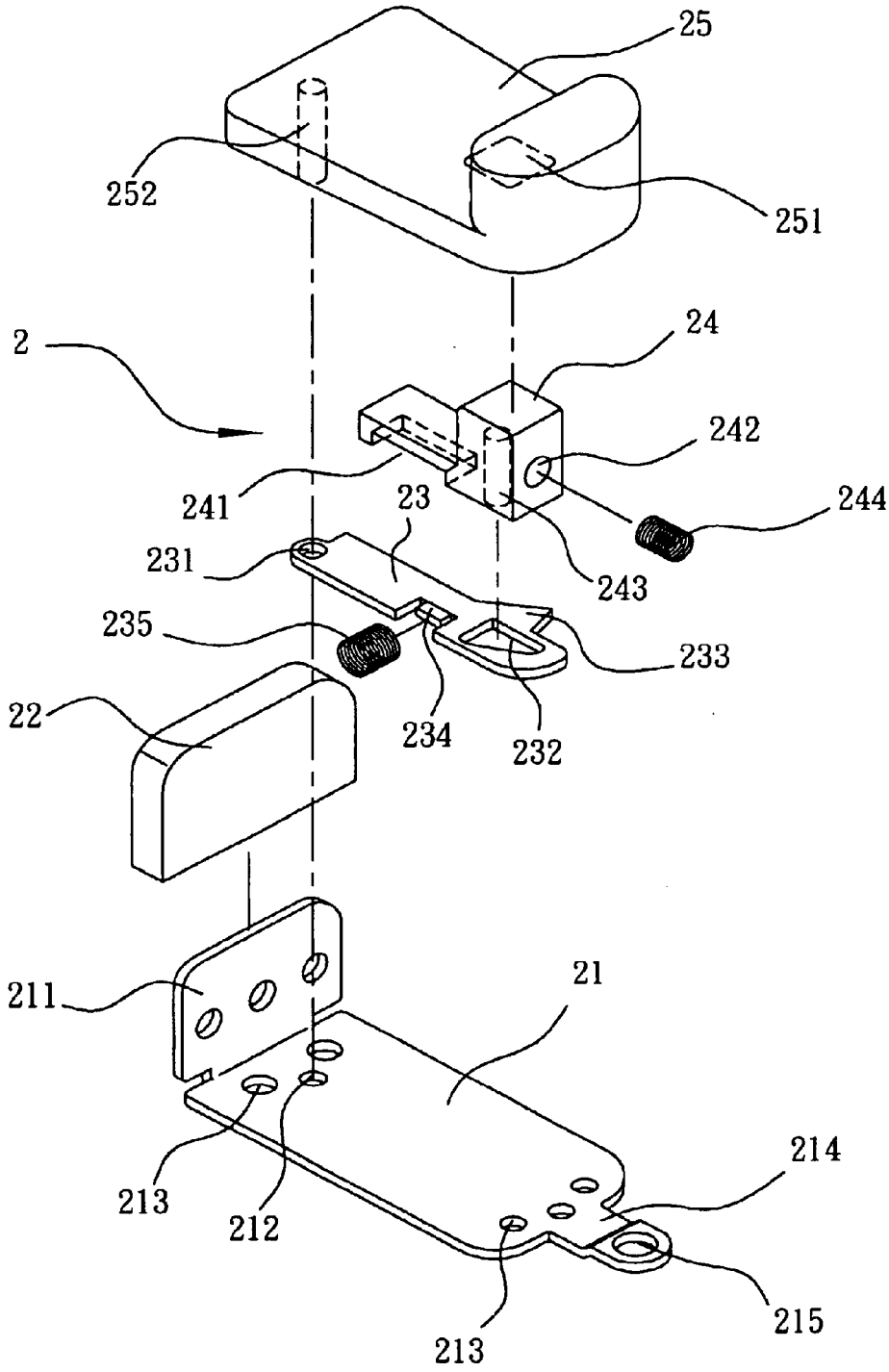
FIG. 2 is an exploded view of the stop plate assembly for the safety door lock according to the present invention.

Referring to FIG. 2 and FIG. 1 again, the stop plate assembly 2 is comprised of a bottom plate 21, a cap 22, a movable engagement plate 23, a button 24, a shell 25, a first spring member 235, and a second spring member 244. The bottom plate 21 comprises a plurality of pivot holes 212 and mounting holes 213, a vertical rear extension portion 211 extended from one end, namely, the rear end at right angles, a horizontal lug 214 extended from the other end, namely, the front end, and a hanging hole 215 in the distal (free) end of the horizontal lug 214. The width of the bottom plate 21 fits the width of the longitudinal sliding way 12 of the positioning plate 1. The cap 22 is a flexible member fixedly capped on the vertical rear extension portion 211 of the bottom plate 21. The movable engagement plate 23 has a cam hole 232 in one end, a through hole 231 in the other end, a projection 234 protruded from the front side adjacent to the cam hole 232 and adapted to support the first spring member 235, and a tooth 233 protruded from the rear side adjacent to the cam hole 232. The cam hole 232 according to this embodiment is a triangular hole. The button 24 has a recessed hole 242 disposed in the vertical front side and adapted to support the second spring member 244, a notched rear extension plate 241 perpendicularly extended from the vertical rear side, and a bottom rod 243 downwardly extended from the bottom side. The shell 25 has a vertical through hole 251 for receiving the bottom 24, and a bottom pivot pin 252 downwardly extended from the bottom side. The assembly process of the stop plate assembly 2 is outlined hereinafter. At first, the second spring member 244 is inserted in the recessed hole 242 of the button 24, and then the button 24 is inserted through the through hole 251 of the shell 25, keeping the notched rear extension plate 241 stopped below the shell 25 and the second spring member 244 stopped against a part of the inside wall of the shell 25, and then the bottom pivot pin 252 of the shell 25 is inserted through the through hole 231 of the movable engagement plate 23 for enabling the bottom rod 243 of the button 24 to pass through the cam hole 232 of the movable engagement plate 23, and then the first spring member 235 is received in the notched rear extension plate 241 of the button 24 and supported between the projection 234 of the movable engagement plate 23 and a part of the inside wall of the shell 25, and then the shell 25 is covered on the bottom plate 21 to force the bottom pivot pin 252 of the shell 25 through the pivot hole 212 of the bottom plate 21, and then screws (not shown) are mounted in the mounting holes 213 of the bottom plate 21 and threaded into respective screw holes (not shown) in the shell 25 to fixedly secure the shell 25 and the bottom plate 21 together.

Figure 3:
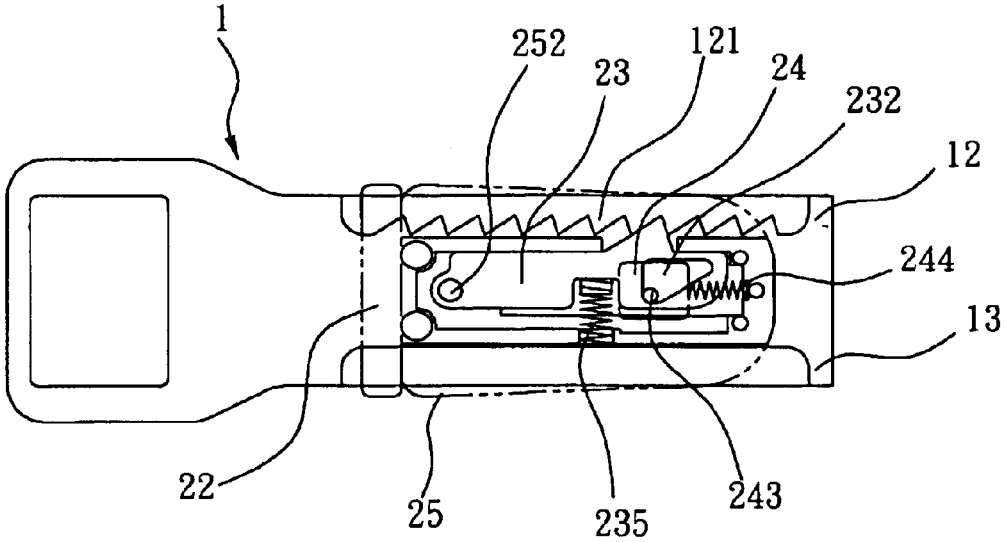
FIG. 3 is a sectional plain view of the present invention, showing the tooth of the movable engagement plate engaged with the serrated longitudinal rail of the positioning plate.
Figure 4:
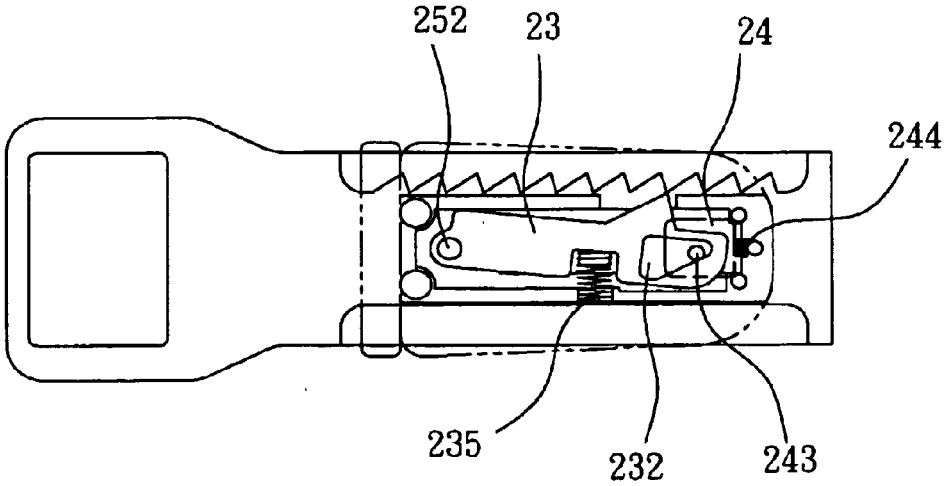
FIG. 4 is similar to FIG. 3 but showing the tooth of the movable engagement plate disengaged from the serrated longitudinal rail of the positioning plate.
Figure 5:
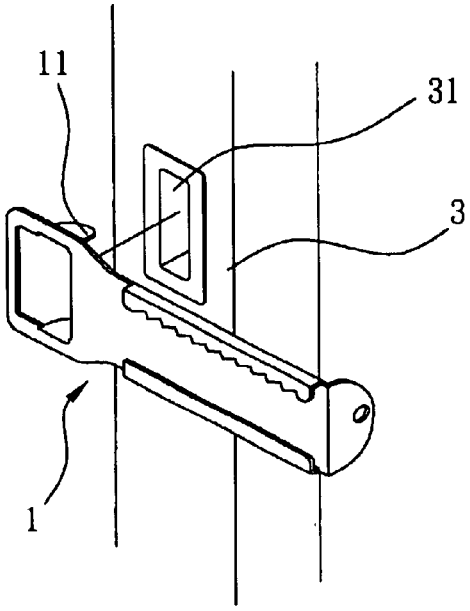
FIG. 5 is a schematic drawing showing the relationship between the positioning plate and the mounting hole in the doorjamb according to the present invention.
Figure 6:
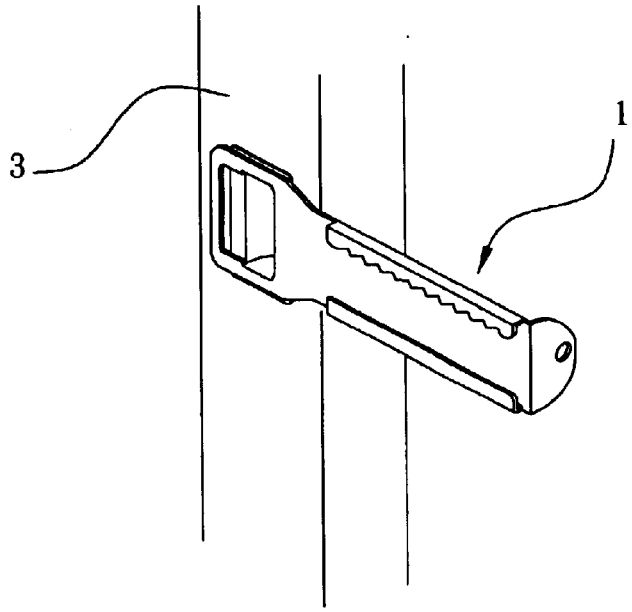
FIG. 6 illustrates the positioning plate fastened to the doorjamb according to the present invention.
Figure 7:
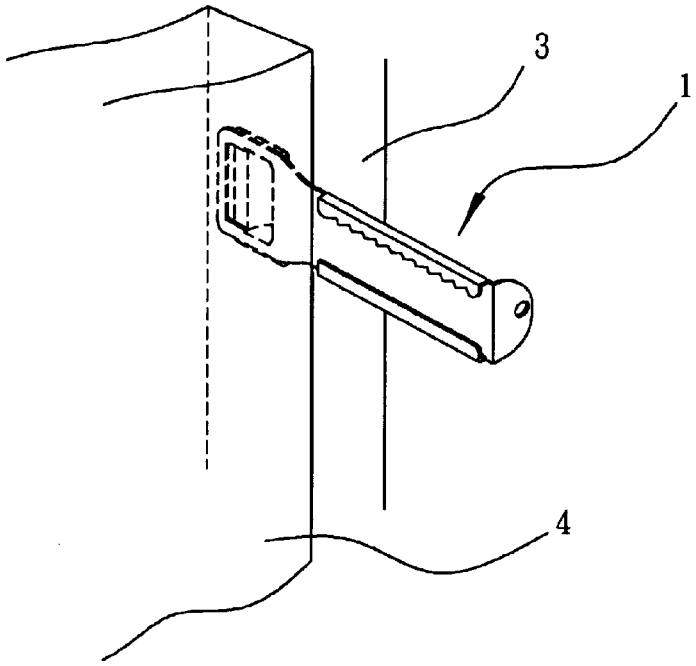
FIG. 7 is a perspective view showing the door panel closed and pressed on the positioning plate against the doorjamb according to the present invention.

Referring to FIGS. 3 and 4, when inserting the bottom plate 21 of the stop plate assembly 2 into the longitudinal sliding way 12 of the positioning plate 1, the tooth 233 is moved with the movable engagement plate 23 over the serrated edge of the serrated longitudinal rail 121. When pulling the stop plate assembly 2 backwards relative to the positioning plate 1, the tooth 233 is engaged with the serrated edge of the serrated longitudinal rail 121 to stop the doorplate assembly 2 from backward displacement (see FIG. 3). When pressed the button 24 at this time, the bottom rod 243 force the movable engagement plate 23 to turn about the bottom pivot pin 252 of the shell 25, thereby causing the tooth 233 to be disengaged from the serrated edge of the serrated longitudinal rail 121, and therefore the stop plate assembly 2 is unlocked and can be disconnected from the positioning plate 1.

Figure 8:
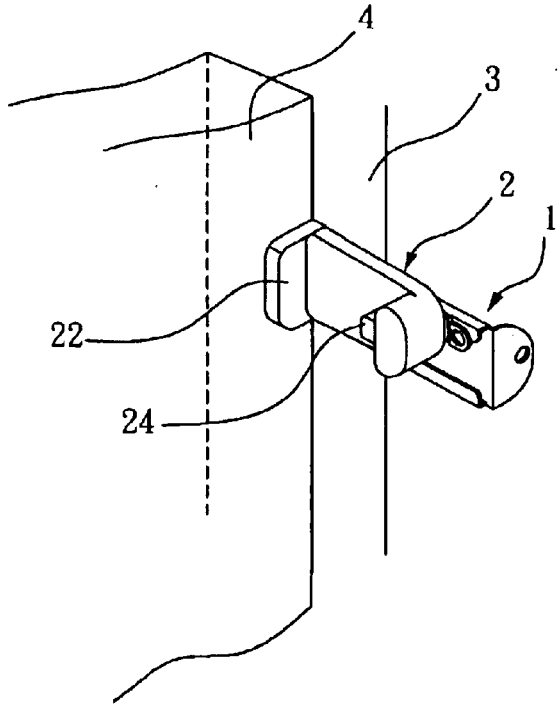
FIG. 8 illustrates the stop plate assembly fastened to the positioning plate at the doorjamb and stopped against the door panel.

Referring to FIGS. 5~8, the mounting lugs 11 of the positioning plate 1 are plugged into the mounting hole 31 in the doorjamb 3 (see FIGS. 5 and 6), and then the door panel 4 is closed, keeping the positioning plate 1 sandwiched in between the doorjamb 3 and the door panel 4 (see FIG. 7), and then the bottom plate 21 of the stop plate assembly 2 is inserted into the longitudinal sliding way 12 of the positioning plate 1 to the position where the cap 22 stopped against the door panel 4 (see FIG. 8). At this time, the tooth 233 is engaged with the serrated edge of the serrated longitudinal rail 121 to stop the stop plate assembly 2 from displacement relative to the positioning plate 1, and therefore the door panel 4 is stopped in the closed position and not openable. When wishing to open the door panel 4, press the button 24 to disengage the tooth 233 from the serrated edge of the serrated longitudinal rail 121, and then disconnect the stop plate assembly 2 from the positioning plate 1 to unlock the door panel 4.

A prototype of safety door lock has been constructed with the features of the annexed drawings of FIGS. 1~8. The safety door lock functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A safety door lock comprising:

a positioning plate for fastening to a doorjamb, said positioning plate comprising a plurality of back mounting lugs disposed near one end thereof for plugging in a mounting hole in a doorjamb to secure said positioning plate to the doorjamb, a longitudinal sliding way defined in a front side thereof, and serrated means longitudinally extended along one side of said longitudinal sliding way; and a stop plate assembly for fastening to said positioning plate to stop a door panel in a closed status closing on the doorjamb in which said positioning plate is installed, said stop plate assembly comprising a bottom plate insertable into the longitudinal sliding way of said positioning plate, said bottom plate comprising a vertical rear extension portion extended from a rear end thereof at right angles for stopping the door panel in the closed position, a shell covered on said bottom plate, said shell having a bottom pivot pin and a through hole, a movable engagement plate mounted inside said shell, said movable engagement plate comprising a pivot hole disposed in a rear end thereof and coupled to the bottom pivot pin of said shell, a cam hole disposed in a front end thereof, and a tooth protruded from one side thereof and adapted to engage the serrated means of said positioning plate and to further stop said stop plate assembly in said positioning plate, a first spring member connected between said movable engagement plate and a part inside said shell and adapted to force the tooth of said movable engagement plate into engagement with the serrated means of said positioning plate, a button mounted inside said shell and partially extended out of the through hole of said shell for pressing by the user, said button having a bottom rod inserted into the cam hole of said movable engagement plate and adapted to bias said movable engagement plate and to further disengage the tooth of said movable engagement plate from the serrated means of said positioning plate when said button pressed by the user, and a second spring member connected between one side wall of said button and a part inside said shell.

2. The safety door lock as claimed in claim 1, wherein said positioning plate comprises two longitudinal rails arranged in parallel and defining therebetween said longitudinal sliding way; said serrated means of said positioning plate is longitudinally formed integral with one of said longitudinal rails.

3. The safety door lock as claimed in claim 1, further comprising a cap capped on the vertical rear extension portion of said bottom plate.

4. The safety door lock as claimed in claim 1, wherein said movable engagement plate has a projection protruded from one side thereof opposite to said tooth and adapted to support said first spring member.

5. The safety door lock as claimed in claim 1, wherein the cam hole of said movable engagement plate has a triangular shape.

6. The safety door lock as claimed in claim 1, wherein said bottom has a recessed hole in one vertical side wall thereof adapted to receive said second spring member.

* * * * *